United States Patent [19]

McIntyre

[11] Patent Number: 4,650,183

[45] Date of Patent: Mar. 17, 1987

[54] EXERCISE APPARATUS FOR CERTAIN FOOT AND ANKLE JOINTS

[75] Inventor: Donald R. McIntyre, Chapel Hill, N.C.

[73] Assignee: Isotechnologies, Inc., Hillsborough, N.C.

[21] Appl. No.: 735,866

[22] Filed: May 20, 1985

[51] Int. Cl.[4] ..... A63B 23/04

[52] U.S. Cl. ..... 272/96; 272/130; 128/25 B

[58] Field of Search ..... 272/134, 130, 93, 96, 272/146, 70; 128/25 R, 25 B, 80 R, 80 DB

[56] References Cited

U.S. PATENT DOCUMENTS

| | | | |
|---|---|---|---|
| 3,020,046 | 2/1962 | Hotas | 272/96 |
| 3,695,255 | 10/1972 | Rodgers et al. | 128/25 B |
| 4,186,920 | 2/1980 | Fiore et al. | 272/96 |
| 4,199,137 | 4/1980 | Giguére | 272/96 |
| 4,337,939 | 7/1982 | Hoyle et al. | 272/96 |
| 4,452,447 | 6/1984 | Lepley et al. | 272/96 |

FOREIGN PATENT DOCUMENTS

| | | | |
|---|---|---|---|
| 2535209 | 5/1984 | France | 272/96 |
| 113030 | 2/1918 | United Kingdom | 128/25 R |
| 902675 | 8/1962 | United Kingdom | 272/97 |
| 848027 | 7/1981 | U.S.S.R. | 128/25 R |

OTHER PUBLICATIONS

Cybex II, Lumex, Inc., Ronkonkoma, N.Y.

A Handbook for Using the Orthotron II System, pp. 13–14, Lumex, Inc., Ronkonkoma, N.Y.

Hydra-Fitness, p. 32, Hydra-Fitness Industries, Belton, Tex.

The Multiaxial Ankle Exerciser, Multiaxial, Inc., Lincoln, R.I.

Orthotron II, Lumex, Inc., Ronkonkoma, N.Y.

Uniaxial and Multiaxial Balance Board Set, Multiaxial, Inc., Lincoln, R.I.

*Primary Examiner*—Richard J. Apley

*Assistant Examiner*—J. Welsh

*Attorney, Agent, or Firm*—Richard E. Jenkins

[57] ABSTRACT

A exercise apparatus for measuring performance of the ankle joint and subtalar joint of a user including a first hydraulic rotary actuator cooperatively associated with the ankle joint and having a rotational axis colinear with the pivotal axis of the ankle joint and a second hydraulic rotary actuator cooperatively associated with the subtalar joint and having a rotational axis colinear with the pivotal axis of the subtalar joint. A seat and a plurality of restraints are utilized in order to restrict motion about adjacent joints of a user and to facilitate alignment of the aforementioned axes of the joints of interest with the axes of the two hydraulic rotary actuators utilized by the apparatus.

11 Claims, 8 Drawing Figures

EXERCISE APPARATUS FOR CERTAIN FOOT AND ANKLE JOINTS

TECHNICAL FIELD

This invention relates to a new apparatus for measuring the functional characteristics of the ankle joint and the subtalar joint of the foot. Even more specifically, the invention enables accurate measurement of the torques exerted about these specific joints and the concomitant angular position changes by providing an exercise apparatus having pivotal axes of movement in colinear alignment with the ankle joint and subtalar joint axes and further having means for restricting motion about adjacent joints during movement about the joints of interest. The apparatus is able to evaluate performance capabilities of the ankle joint and the subtalar joint of the foot much more accurately that has heretofore been possible.

BACKGROUND ART

The use of an exercise apparatus in order to exercise for physical therapy purposes or to exercise for diagnostic and rehabilitation purposes is known. A representative patent is U.S. Pat. No. 4,452,447 which issued to the assignee of the present invention and was directed to an ankle exerciser adapted for permitting isokinetic exercise of the ankle joint of the user. The apparatus provided for movement about three mutually perpendicular axes with each axis of movement having a double-action hydraulic cylinder associated therewith in order to permit selected resistance to motion about that axis. This apparatus, although originally believed to permit free movement of the ankle joint, resulted in some binding thereof since the three mutually perpendicular axes of movement were not colinear with the natural axes of the foot or ankle. The result was an apparatus which was not entirely satisfactory with respect to its intended purpose.

Also, it should be understood that other ankle exercise apparatus are known which provide for exercise of the ankle joint for rehabilitation purposes including the ORTHOTRON II manufactured by Lumex, Inc. of Ronkonkoma, N.Y. This apparatus provides for plantar flexion and dorsiflexion movement of the foot about the axis of the ankle joint against a rotary actuator-type resistance means having a rotational axis in alignment or colinear with the ankle axis with the foot properly positioned in the foot plate mechanism of the exercise apparatus. This apparatus allows ankle joint exercise with the user in prone position or in supine position with the knee flexed.

The CYBEX II apparatus, also manufactured by Lumex, Inc. of Ronkonkoma, N.Y., is a commercial system for measurement of isolated joint movement and functional capabilities of the ankle joint. The apparatus provides for independent exercise and measurement of the ankle joint during plantar flexion and dorsiflexion motion and of the subtalar joint of the foot during inversion and eversion motion. However, this apparatus is understood to utilize only a single rotary resistance means so as to require separate and distinct tests to evaluate the ankle joint or other joints of interest. The CYBEX II apparatus does provide for colinear alignment of the rotary resistance means axis with the axis of the ankle joint or other joint to be tested or exercised.

Also of possible interest is the MULTIAXIAL ANKLE EXERCISER manufactured by Multiaxial, Inc. of Lincoln, R.I. Unlike apparatus which provide for evaluation of the performance of a joint or joints of interest, this apparatus essentially is an ankle exercise apparatus comprising a foot plate with associated straps to secure the foot thereto and pivotally secured to the top of a pedestal for universal and multiaxial movement against an adjustable resistance. The ankle exercise apparatus, although providing for complex combinations of movements against a predetermined resistance, does not utilize either independent resistance means for each axis of movement or the hydraulic rotary actuator-type resistance means utilized in the instant invention. This apparatus is not believed capable of providing meaningful performance evaluation of the ankle joint or subtalar joint but merely provides for exercise of the foot about a plurality of axes including the axes of the ankle joint and the subtalar joint.

In summary, it is believed that known foot and ankle joint exercise apparatus are not entirely satisfactory to analyze performance of the subtalar joint and the ankle joint. Moreover, it is believed that none of the prior art machines provide for a hydraulic resistance means to be associated with movement about both the ankle and subtalar joint axes and which have rotational axes colinear with both the pivotal axes of the subtalar joint and the ankle joint so as to accommodate natural movement of the foot and ankle during exercise and/or performance evaluation.

DISCLOSURE OF THE INVENTION

The present invention is directed to a new apparatus designed to measure the functional characteristics of the ankle joint and the subtalar joint of the foot. Accurate measurement of the pounds-feet of torque exerted by pivotal movement about the joint axes and the concomitant angular position changes are achieved by restricting motion about adjacent joints with a plurality of restraints and by aligning the axes of the ankle joint and subtalar joint so as to be colinear with the pivotal axes of movement provided for by the apparatus. The biaxial functional measurement provided for by the instant invention includes plantar flexion and dorsiflexion motion about the ankle joint and inversion and eversion motion about the subtalar joint or the two motions simultaneously. A predetermined and independent resistance to motion can be selected for each of the two axes. The ankle and subtalar joint exercise apparatus is focused on performance evaluation of these two particular joints since they tend to be the primary joints associated with the foot which are prone to injury or deficit and requiring subsequent performance evaluation and rehabilitation.

The apparatus of the present invention comprises a foot plate assembly mounted to a frame and including means for securing the foot of the user to the assembly. The foot plate assembly is constructed so as to permit pivotal movement about the natural axis of the subtalar joint and/or the ankle joint of a user positioned in a seated posture on the apparatus. Restraint means including "Velcro" secured straps are used to restrain the thigh and leg of the user against motion so that only pivotal movement of the ankle joint and/or subtalar joint is allowed by the foot plate assembly in order to better assess performance of these joints of interest. A first hydraulic resistance means, preferably a rotary hydraulic actuator such as a dynamometer, is secured directly to the foot plate assembly so that its rotational axis is colinear with the axis of movement of the subtalar joint. A second hydraulic resistance means is operatively associated with the foot plate assembly and positioned on the apparatus so that its rotational axis is colinear with the axis of the ankle joint of a user. In this fashion, the foot plate assembly with a user's foot snugly secured thereto is capable of bi-axial pivotal movement about the natural axes of the subtalar joint and the ankle joint against a predetermined and preselected independent resistance on each axis in order to evaluate joint performance. The colinear alignment of the two hydraulic rotary actuators with the joint axes provides for natural and non-binding motion of the joints and results in superior performance evaluation accuracy.

Of further specific interest, it should be pointed out that the foot plate comprises a first support element fixedly secured to the shaft of the first hydraulic rotary actuator and includes support means for the heel of a user mounted thereon. A second support element is pivotally secured to the remote end of the first support element and adapted so as to support the forefoot of a user. The first hydraulic rotary actuator is positioned relative to the foot plate assembly so that its axis extends upperwardly at a 42 degree inclination to the foot plate and inwardly at a 16 degree medial deviation from the midline of a foot secured to the foot plate. This is significant since this position of the first hydraulic rotary actuator aligns its rotational axis so as to be colinear with the subtalar joint of a user's foot. A "U" bar supporting the foot plate and first rotary actuator is pivotally mounted on the apparatus frame with one arm fixedly secured to the rotational shaft of the second hydraulic rotary actuator with its rotational axis extending through and colinear with the ankle joint axis of a user of the apparatus. This colinear alignment of the axes of the ankle and subtalar joints with the axes of movement of the apparatus of the invention is believed to be new and to provide for accuracy in the performance evaluation of these joints which was not heretofore possible.

Therefore, it is a primary object of the present invention to provide a new apparatus for the exercise of the ankle joint and subtalar joint of a user.

Another object of the invention is to provide a new apparatus of a novel construction which is capable of performance evaluation of the ankle joint and subtalar joint of a user not heretofore possible.

A still further objective of the invention is to provide an ankle joint and subtalar joint exercise apparatus adapted for allowing motion of the foot of a user about the natural axes of the ankle joint and the subtalar joint by providing an independent hydraulic resistance means associated with each axis and positioned with its rotational axis colinear with the joint axis so that each joint may move against a predetermined resistance in a natural manner.

Further features and advantages of the invention will become more readily apparent from the following detailed description when taken in conjunction with the accompanying drawings.

BEST MODE FOR CARRYING OUT THE INVENTION

Figure 1:
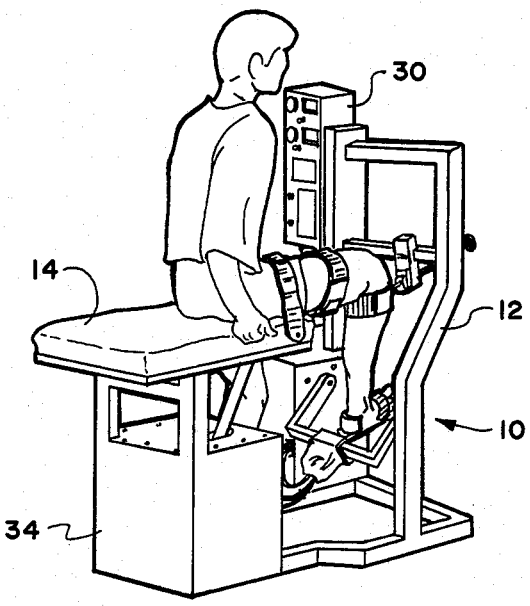
FIG. 1 is a perspective view of a user seated on the apparatus of the present invention.

The inventive apparatus can best be described as an exercise apparatus for the ankle joint and subtalar joint which provides for movement about the natural axes of these joints against an independent and predetermined resistance on each axis in order to accurately and comfortably measure joint motion. It is not believed by the applicant that any apparatus presently exists which can measure the performance of these joints simultaneously and is constructed so that the hydraulic resistance means associated with each natural joint has a colinear rotational axis therewith so as to provide for natural and non-binding movement of the ankle and subtalar joints during performance evaluation.

The apparatus of the invention, generally designated 10 (see FIGS. 1, 2 and 4), for exercise and performance evaluation of the ankle joint and the subtalar joint of the foot comprises a frame 12 which supports a seat 14 for a user, a foot plate assembly, generally designated 16, which is pivotally connected to frame 12 by U bar 21 of foot plate assembly 16, first hydraulic resistance means 18 positioned immediately behind foot plate assembly 16, and second hydraulic resistance means 20 cooperatively connected to one end of U bar 21 of foot plate assembly 16.

Figure 2:
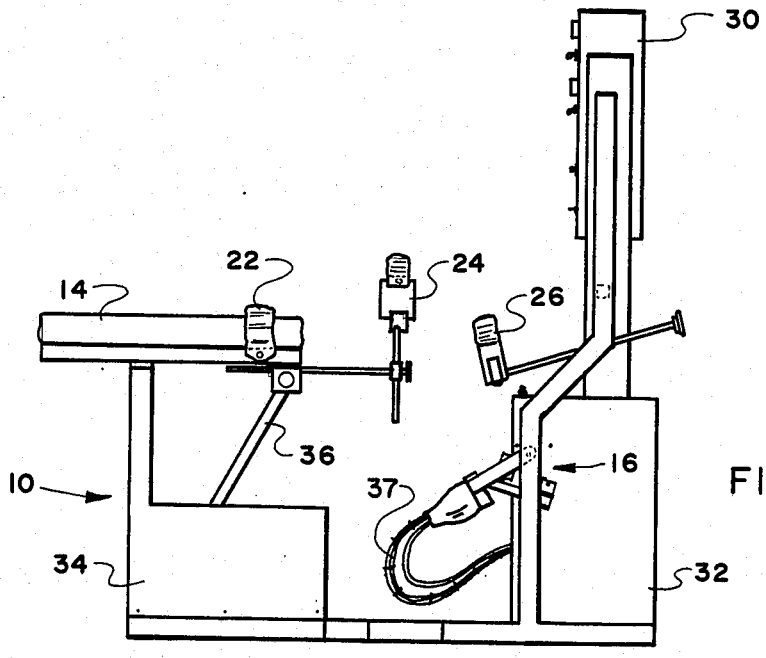
FIG. 2 is a side elevation view of the apparatus of the present invention.

The apparatus also includes a first thigh restraint 22, a second thigh restraint 24, and a leg restraint 26. Finally, as best seen in FIGS. 1 and 2, the exercise apparatus of the present invention includes a control panel 30 which includes instrumentation and conventional electronic circuitry to independently select the pounds-feet of torque resistance at first hydraulic resistance means 18 and second hydraulic resistance means 20, a first cabinet 32 which encloses second hydraulic resistance means 20 (see FIG. 4) and conventional hydraulic circuitry and electrical circuitry (not shown) utilized by apparatus 10, and a second cabinet 34 located immediately beneath seat 14 and enclosing a conventional electric motor and drive means to tilt the front edge of seat 14 by raising and lowering seat support member 36. Finally, it should be noted that the hydraulic circuitry (not shown) within first cabinet 32 fluidly communicates with first hydraulic resistance means 18 secured to the rear of foot plate assembly 16 through hydraulic lines 37.

Figure 3A:
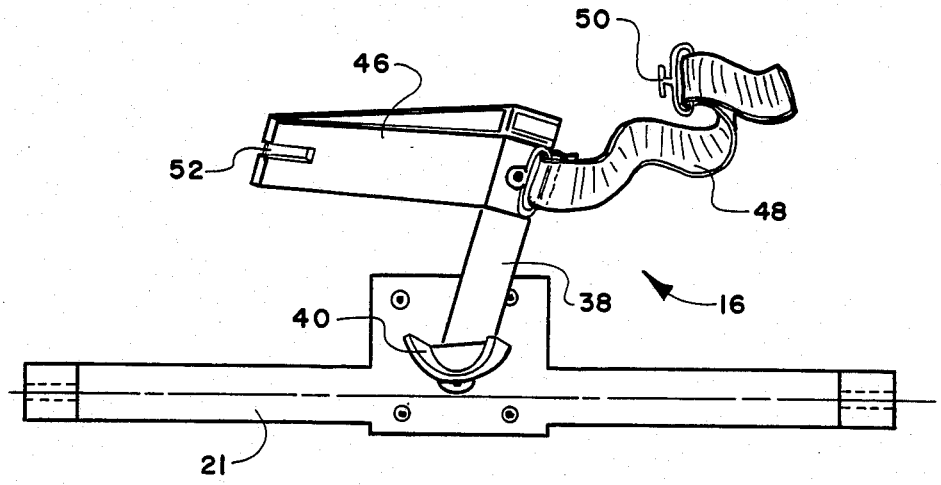
FIG. 3A is a top plan view of the foot plate assembly neutrally positioned to receive the left foot of a user.
Figure 3B:
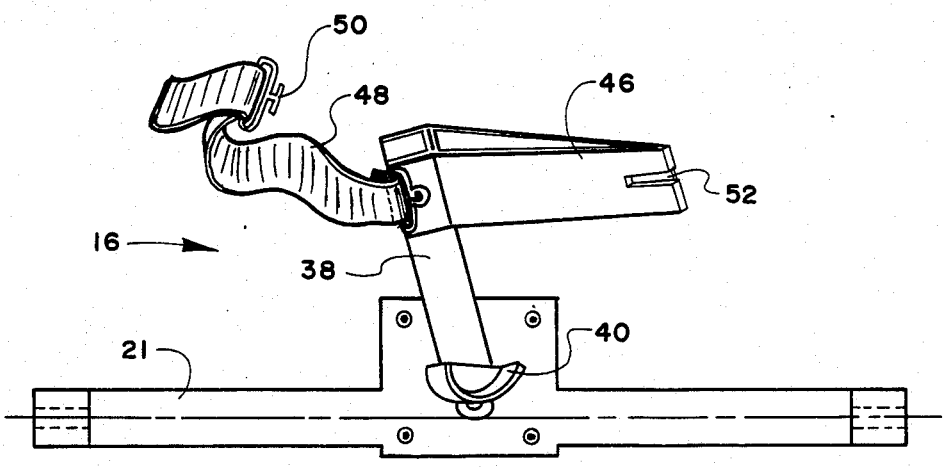
FIG. 3B is a top plan view of the foot plate assembly neutrally positioned to receive the right foot of a user.
Figure 4:
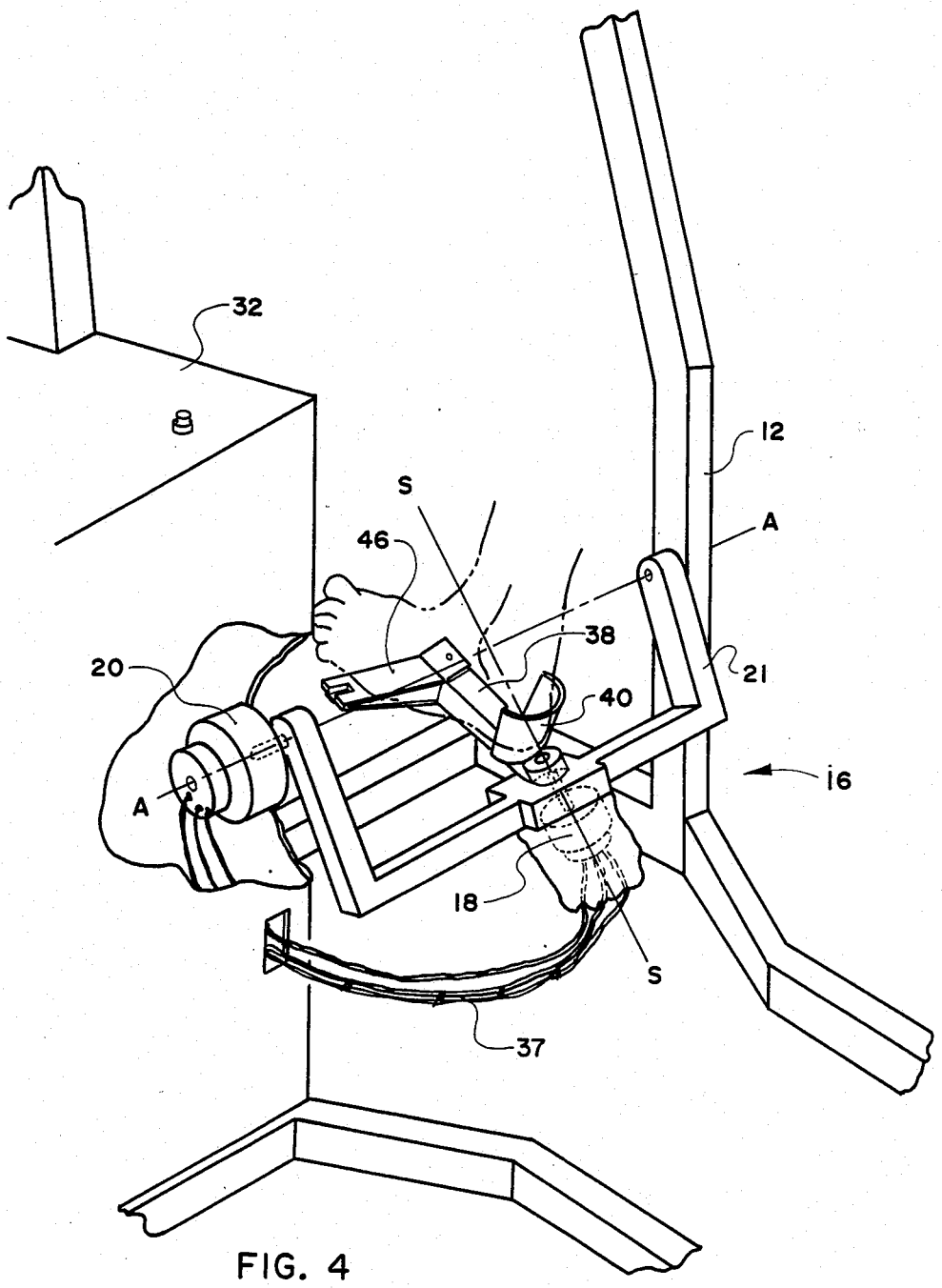
FIG. 4 is a perspective view of the foot plate assembly of the present invention with phantom lines depicting the left foot of the user properly placed thereon with parts broken away and the strap removed for clarity.

In order to obtain a full appreciation of the exercise apparatus of the present invention, the foot plate assembly 16, as best shown in FIGS. 3A, 3B and 4, will be described in full detail hereafter. Prior to reviewing the elements of foot plate assembly 16, it should be again observed that the novel assembly is so constructed as to provide for bi-axial movement about the ankle joint and the subtalar joint of a user. This is accomplished by positioning first hydraulic resistance means 18 and second hydraulic resistance means 20 so that the rotational axis of first hydraulic resistance means 18 is colinear with the axis of the subtalar joint and the rotational axis of second hydraulic resistance means 20 is colinear with the axis of the ankle joint (see FIG. 4). This is believed to be a novel feature of the exercise apparatus of the present invention and to provide for superior performance evaluation of these joints.

Figure 5:
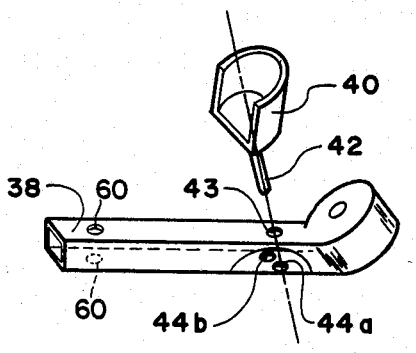
FIG. 5 is a pictorial view of the first support element and the heel support of the foot plate assembly with parts broken away for clarity.

Foot plate assembly 16 can be seen to comprise rigid foot support element 38 which is fixedly secured at the lower end thereof to the rotational shaft of first hydraulic resistance means 18. Foot support element 38 and hydraulic resistance means 18 are mounted on and supported by U bar 21 of foot plate assembly 16 which pivotally engages frame 12 with one arm and is fixedly secured to the rotational shaft of hydraulic resistance means 20 with the other arm (see FIG. 4). A heel support 40 is pivotally mounted upon foot support element 38 (see FIGS. 4 and 5) so as to pivot through an arc of about 32 degrees in order to accommodate either the right foot or the left foot of a user. It should be noted that heel support 40 includes a pin 42 depending downwardly therefrom for extending through an aperture 43 (FIG. 5) in the top of foot support element 38 and a second aperture in the bottom thereof which allows it to freely pivot. In order to best accommodate either foot of a user, heel support pin 42 may be slidably received by singular hole 43 in the top of foot support element 38 and then slidably received by either of two laterally spaced-apart apertures **44*a* and 44*b* in the bottom of foot support element 38 depending upon whether the right or left foot is being exercised. By way of example, heel support pin 42 is placed through bottom aperture 44*a* (see FIG. 5) when the right foot of the user is secured to foot plate assembly 16 in order to provide an outward lateral tilt to heel support 40 and heel support pin 42 is placed in aperture 44*b* when the left foot of the user is secured to foot plate assembly 16** in order to provide a tilt toward the outside direction of the left foot.

Foot support element 38 has a forefoot support element 46 pivotally secured to the free end thereof remote from first hydraulic resistance means 18. Forefoot support element 46 pivots about aperture 60 of foot support element 38 shown in FIG. 5 since the end of forefoot support element 46 is not closed or otherwise constructed so as to present pivotal movement about an arc. Forefoot support element 46 is pivotally secured at one end to foot support element 38 so as to extend generally outwardly therefrom with a slight upward inclination (see FIGS. 3A and 3B). A forefoot strap 48 is provided to secure the foot of the user to foot plate assembly 16. More particularly, forefoot strap 48 is pivotally secured at one end to the end of forefoot support element 46 pivotally secured to foot support element 38 and the strap at its free end includes a buckle and associated T-bar 50 which is slidably received by an open slot 52 defined by the free end of forefoot support element 46. Forefoot strap 48 can be adjusted and secured by conventional Velcro means at its end adjacent buckle and T-bar 50.

As best seen in FIG. 3A, forefoot support element 46 extends laterally outwardly from foot support element 38 in order to accommodate the left foot of a user on the exercise machine of the present invention. In order to accommodate the right foot of a user thereon, forefoot support element 46 is pivoted through an arc to a position best shown in FIG. 3B. The arc angle may be more or less than 180 degrees as needed to accommodate the foot size of a user. When the foot of a user is secured to foot plate assembly 16 it is so positioned that the rotational axis of hydraulic resistance means 20 is colinear with the ankle joint (see FIG. 4) and the rotational axis of first hydraulic resistance means 18 is colinear with the subtalar joint axis. It should be apparent that FIGS. 3A and 3B depict foot plate assembly 16 in its neutral position and ready to receive the left foot and right foot, respectively, of a user.

Figure 6:
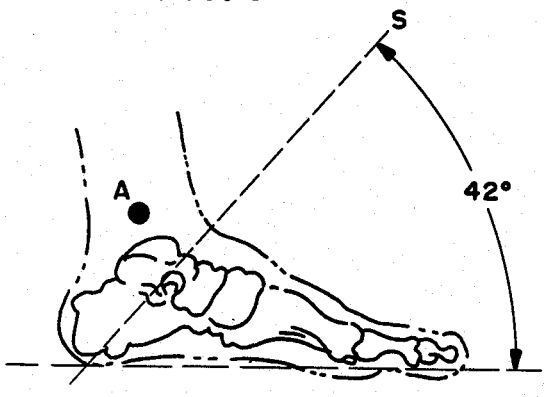
FIG. 6 is a diagrammatic representation of the left foot of a user illustrating the axes of the subtalar joint and the ankle joint.
Figure 7:
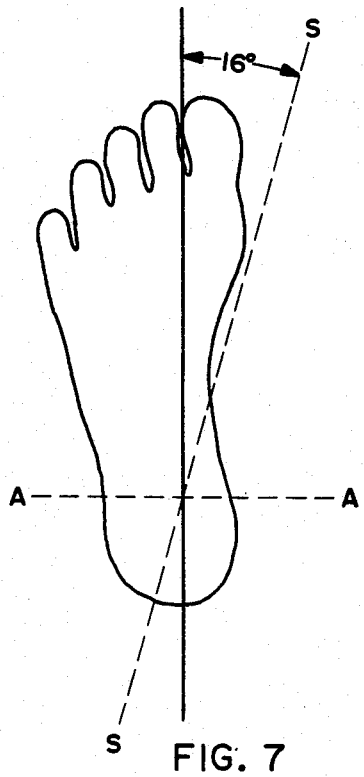
FIG. 7 is a top plan diagrammatic view of the left foot of a user illustrating the axes of the subtalar joint and ankle joint.

The axis about which the ankle moves during plantar flexion and dorsiflexion movement is designated A in FIG. 4 and can also be observed in FIGS. 6 and 7. The axis of the subtalar joint of the foot is designated S in FIG. 4 and can also be further understood by reference to FIGS. 6 and 7. Subtalar joint axis S which is colinear with the rotational axis of first hydraulic resistance means 18 associated with foot plate assembly 16 extends at an upward inclination of about 42 degrees to the plane upon which the foot rests and at a medial deviation of about 16 degrees from the midline toward the inside of the foot.

In operation, the invention first requires that a user be seated upon seat 14 of the exercise apparatus 10. Then the leg associated with the ankle joint and/or subtalar joint of interest and the performance thereof evaluated may be secured by first thigh restraint 22 and, as appropriate, by second thigh restraint 24. Next, the leg below the knee is secured by leg restraint 26 and the foot positioned on heel support 40 and forefoot support 46 of foot plate assembly 16 is secured by forefoot strap 48. More specifically, first thigh restraint 22 may be passed over the thigh of the user and attached with conventional Velcro means to the other side of seat 14 in order to restrain a user's thigh when testing is conducted with the knee of a user in an extended or nearly extended position. Second thigh restraint 24 is typically also used when testing with the knee flexed and may be movably adjusted either forward toward foot plate assembly 16 or backward therefrom and vertically upward or downward in order to assure contact with the posterior medial and lateral aspects of the thigh. Second thigh restraint 24 is preferably padded on the inside curve surface thereof and can also be pivoted in order to maximize the thigh contact area.

With the thigh securely restrained as described above, seat 14 may be tilted by actuation of an electric motor means (not shown) associated with movable seat support member 36 in order to bring the heel of a user's foot into firm contact with foot plate assembly 16. Seat 14 also is adapted to be adjusted either forward or backward if required. With respect to adjusting leg restraint 26, it should be fully appreciated that leg restraint 26 may be both rotated and moved generally toward and away from the leg of a user. Also, leg restraint 26 may be tilted as necessary. Inward movement of the leg restraint causes the curved surface thereof to apply a backward and downward force on the anterior surface of a user's leg and rotation of the curved surface of leg restraint 26 insures maximum contact with user's leg. As with the other restraints of the apparatus, leg restraint 26 provides for a strap with conventional Velcro means to secure the leg to the restraint. It should be apparent that the restraint system of apparatus 10 is designed so as to restrict motion of the lower limb segments proximal to the ankle joint while allowing the ankle and subtalar joints to be moved at any selected orientation of the knee of a user.

Finally, looking specifically at forefoot strap 48 of foot plate assembly 16, it should be appreciated that it is utiliZed to maintain the forefoot of the user in fixed contact with the foot plate assembly 16 and that correct positioning of the foot thereon provides for forefoot strap 48 overlaying the medial aspect of the foot. Movement of a user's foot within foot plate assembly 16 is further restricted by heel support 40.

With either the left foot or the right foot of a user secured as described above a predetermined resistance in pounds-feet of torque is independently selected on control panel 30 for first hydraulic resistance means 18 associated with movement about the subtalar joint and second hydraulic resistance means 20 associated with movement about the ankle joint. It should be noted that both hydraulic resistance means utilized by the instant invention are conventional rotary hydraulic actuators. Next, a user moves his foot about the ankle joint in plantar flexion and dorsiflexion motion and about the subtalar joint in inversion and eversion motions. Simultaneous movements involving both of these joints of interest is also possible and may be appropriate. The pounds-feet of torque effort exerted by a user and the associated position changes about each of the two axes of movement are determined by the apparatus of the present invention and analyzed by a conventionally programmed and electrically associated personal computer in order to determine functional or performance characteristics of the ankle and/or the subtalar joint. The computerized evaluation of the joint movement may be utilized to determine the extent of deficiency of performance of the joint or joints of interest due to athletic injury or other cause such as the aging process. It should be further appreciated that the program to be utilized by the associated computer may provide graphs, reports and protocols in addition to storage, retrieval and comparisons.

In conclusion, the subject invention provides for a novel bi-axial exercise apparatus capable of heretofore unavailable performance evaluation accuracy in view of its ability to provide for movement about the natural axes of the subtalar joint of the foot and the ankle joint. This is accomplished by positioning a hydraulic rotary actuator in conjunction with each joint of interest so that its rotational axis is colinear with the pivotal axis of its associated joint of interest. More specifically, the hydraulic rotary actuator cooperatively associated with the ankle joint has a rotational axis colinear with the ankle joint axis and the hydraulic rotary actuator associated with the subtalar joint has a rotational axis which is colinear with the subtalar joint axis. It is not believed that this particular combination of features is presently known in any other exercise apparatus of this type.

While the instant invention has been shown and described herein in what is conceived to be the most practical and preferred embodiment, it is recognized that departures may be made therefrom within the scope of the invention, which is therefore not to be limited to the details disclosed herein but is to be accorded the full scope of the claims so as to embrace any and all equivalent apparatus.

What is claimed is:

1. An apparatus for exercising the ankle and subtalar joints of a user comprising:

a frame;

a foot plate assembly mounted to said frame including a support member pivotally engaging said frame so as to pivot about a substantially horizontal axis, and a foot engagement means carried by said support member and being pivotally movable relative to said support member about a second axis offset from the longitudinal midline of the foot engagement means and extending upwardly at an angle of about 30–50 degrees from the bottom plane of said foot engagement means wherein said horizontal axis is the natural axis of the ankle joint and said second axis is the natural axis of the subtalar joint;

first resistance means operatively connected to said support member;

second resistance means carried by said support member and operatively connected to said foot engagement means; and restraint means for securing proximal body segments of the user's foot to said exercise apparatus;

whereby said foot plate assembly allows the user's foot to pivot about the natural axis of the ankle joint during movement against said first resistance means and to pivot about the natural axis of the subtalar joint of the foot during movement against said second resistance means.

2. An apparatus as claimed in claim 1 wherein said first resistance means comprises a hydraulic rotary actuator having its shaft axis colinear with said substantially horizontal axis.

3. An apparatus as claimed in claim 1 wherein said second resistance means comprises a hydraulic rotary actuator having its shaft axis colinear with said second axis.

4. An apparatus as claimed in claim 1 wherein said apparatus further includes a seat for the user supported by said frame and including a motor and gear assembly to provide horizontal and vertical adjustment to said seat in order to maintain firm contact of the foot of the user with said foot plate assembly at any orientation of the knee joint of the user.

5. An apparatus as claimed in claim 1 wherein said restraint means comprises a thigh restraint and a leg restraint.

6. An apparatus as claimed in claim 1 wherein said foot engagement means of said foot plate assembly comprises a first portion including means to support the heel and cooperatively engaging said second resistance means and a second portion pivotally secured to said first portion to support the forefoot.

7. An apparatus as claimed in claim 6 wherein said heel support means comprises a pivotally mounted heel support element.

8. An apparatus as claimed in claim 7 wherein said second portion of the foot plate assembly is pivotally secured at one end to said first portion so as to extend outwardly to one side thereof and which may be pivoted through an arc so as to extend outwardly to the other side thereof in order for the foot plate assembly to accommodate either foot of the user.

9. An apparatus as claimed in claim 8 wherein said heel support element may freely pivot from side to side when said second portion of said foot plate assembly is pivoted in order to accommodate either foot of the user on said foot plate assembly.

10. An apparatus as claimed in claim 9 wherein said second portion of the foot plate assembly includes an adjustable strap to secure the forefoot of the user thereto.

11. An apparatus as claimed in claim 1 further comprising means to independently select the resistance to be provided by said first and said second resistance means to movement of the subtalar and ankle joints, respectively, of the user.

* * * * *